United States Patent [19]

Weldon-Ming

[11] Patent Number: 4,519,318

[45] Date of Patent: May 28, 1985

[54] COLLAPSIBLE SUPPORT STRUCTURES

[76] Inventor: Richard S. Weldon-Ming, 101 Waterfall Ave., Craighall, Johannesburg, Transvaal, South Africa

[21] Appl. No.: 458,028

[22] Filed: Jan. 14, 1983

[51] Int. Cl.[3] ..... A47B 3/06; A47B 47/00

[52] U.S. Cl. ..... 108/33; 108/38; 108/159; 220/4 F; 248/150; 248/461; 312/259

[58] Field of Search ..... 108/33, 34, 38, 111, 108/159; 312/259, 262; 248/174, 150, 165, 461; 220/4 F; 206/576, 577; 297/442

[56] References Cited

U.S. PATENT DOCUMENTS

| | | | |
|---|---|---|---|
| 2,039,823 | 5/1936 | Miller | 312/259 |
| 2,388,192 | 10/1945 | Stechbart | 108/33 X |
| 2,801,145 | 7/1957 | Jones | 312/259 |
| 3,089,632 | 5/1963 | Bartolucci | 248/174 X |
| 3,480,796 | 11/1969 | Simas | 108/55.1 X |
| 4,085,847 | 4/1978 | Jacalone | 108/51.3 X |
| 4,385,782 | 5/1983 | Clark, Jr. | 297/352 X |

FOREIGN PATENT DOCUMENTS

| | | | |
|---|---|---|---|
| 653120 | 11/1937 | Fed. Rep. of Germany | 108/38 |

*Primary Examiner*—Victor N. Sakran
*Assistant Examiner*—Peter R. Brown
*Attorney, Agent, or Firm*—Stevens, Davis, Miller & Mosher

[57] ABSTRACT

A collapsible table is formed of a base 10, a lid 14, a foldable planar member 20 and two rectangular box-like structures 22 and 24. The member 20 and structures 22 and 24 can be collapsed and folded to fit into a closed box formed of the base 10 and the lid 14.

6 Claims, 4 Drawing Figures

FIG _ 1
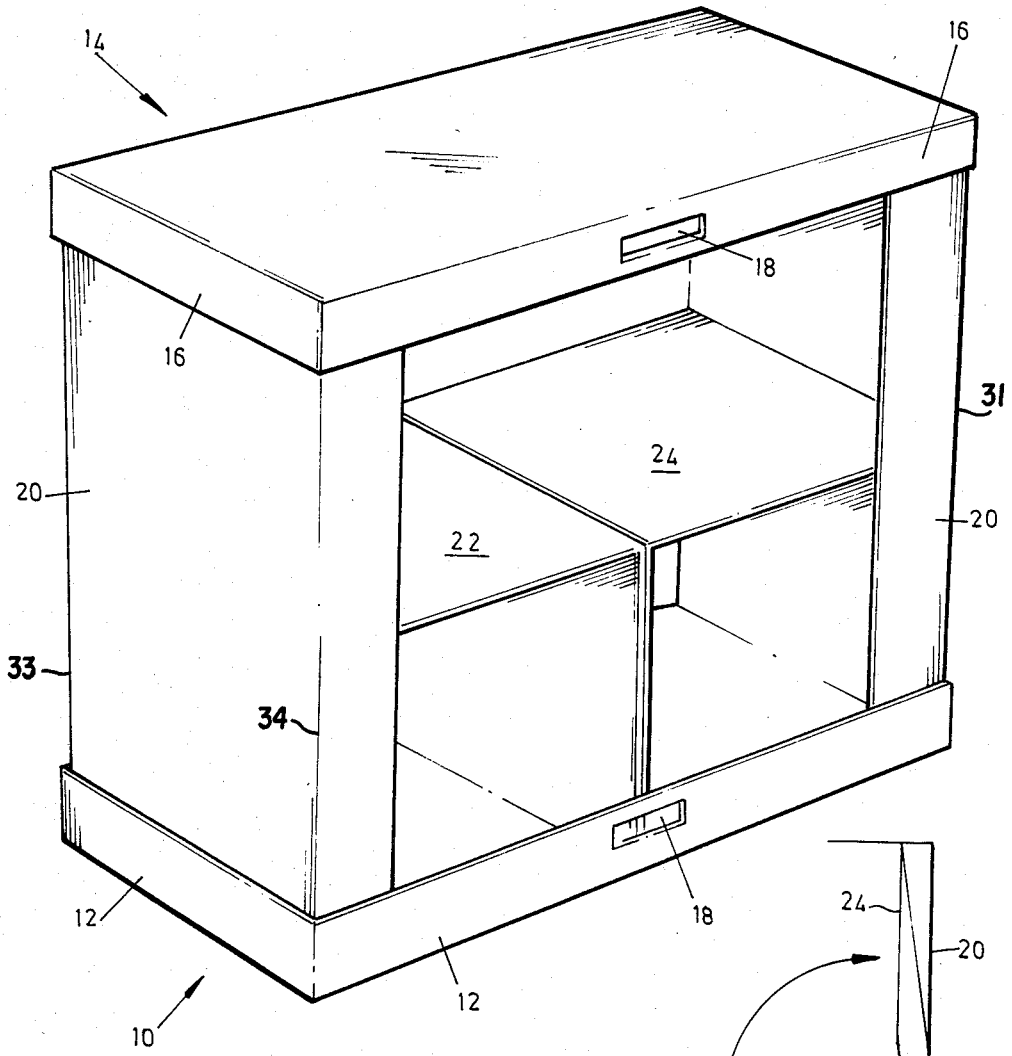
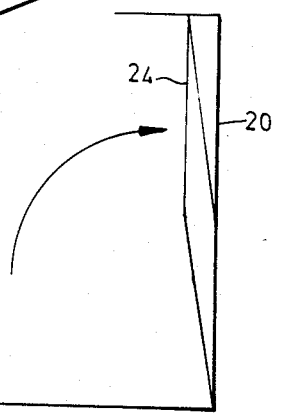
FIG _ 4

COLLAPSIBLE SUPPORT STRUCTURES

BACKGROUND OF THE INVENTION

The invention relates to collapsible support structures.

Such structures are required for use as temporary supports for display and demonstration of goods as well as for casual use at picnics and the like. Conventionally, the most common structures of this kind are foldable trestle tables or so-called "card tables" having foldable legs. These tables tend to be bulky even when folded; they are relatively heavy and when used for demonstration or display purposes provide no out-of-view storage space until suitably decorated or draped with material such as a table cloth extending to ground or floor level.

It is an object of the invention to provide an improved collapsible support structure which at least reduces these problems.

SUMMARY OF THE INVENTION

According to the invention there is provided a collapsible support structure comprising a rectangular base having upstanding edges which meet to form four corners of the base, a lid having upstanding edges which meet to form four corners of the lid, the lid being arranged to form a closed box with the base when the lid and base are fitted together and the upstanding edges mate against one another, a foldable planar member arranged to fit when folded into the closed box and when unfolded to fit with opposite extreme surface regions thereof respectively against the upstanding edges and into the four corners of the base and the lid and to support and displace the lid relative to the base, and foldable rectangular open box means which fits into the closed box when folded and the side of which when unfolded locks into a rectangular form by pressing against respective inside surfaces of the planar unfolded member to urge the respective extreme surface regions of the planar member towards the upstanding surfaces of the base and the lid so as to form and retain the structure in its supporting configuration.

The rectangular open box means may be secured to and against an inside surface of the planar member and which is arranged to fold inside the planar member and such that the rectangular open box means structure and planar member remain secured together when they are folded and placed in the closed box.

Two rectangular structures may be provided which have together when in rectangular form overall dimensions equal to the length and width of the inside of the planar member when in its supporting configuration.

The planar member when unfolded may extend only partially along one side of the structure in its supporting configuration to allow ready access to the inside of the structure.

The rectangular open box means may be positioned so as to be open to allow access to the inside thereof from said one side.

The parts from the collapsible structure may be formed of cardboard, plastics material and the like.

A canopy may be arranged and supported above the structure by rods which are releasably fixed to the structure.

A slot may be provided in one of the upstanding edges of the base and a corresponding slot provided in the upstanding edges of the top to provide a carrying aperture for the structure in its folded closed box configuration.

BRIEF DESCRIPTION OF THE DRAWINGS

A collapsible table arrangement according to the invention will now be described by way of example with reference to the accompanying drawings in which:

FIG. 1 is an isometric view of the table in assembled form;

FIG. 4 is a cross-sectional view of part of the table in a position adopted during assembly.

DESCRIPTION OF A PREFERRED EMBODIMENT

Figures 2, 3:
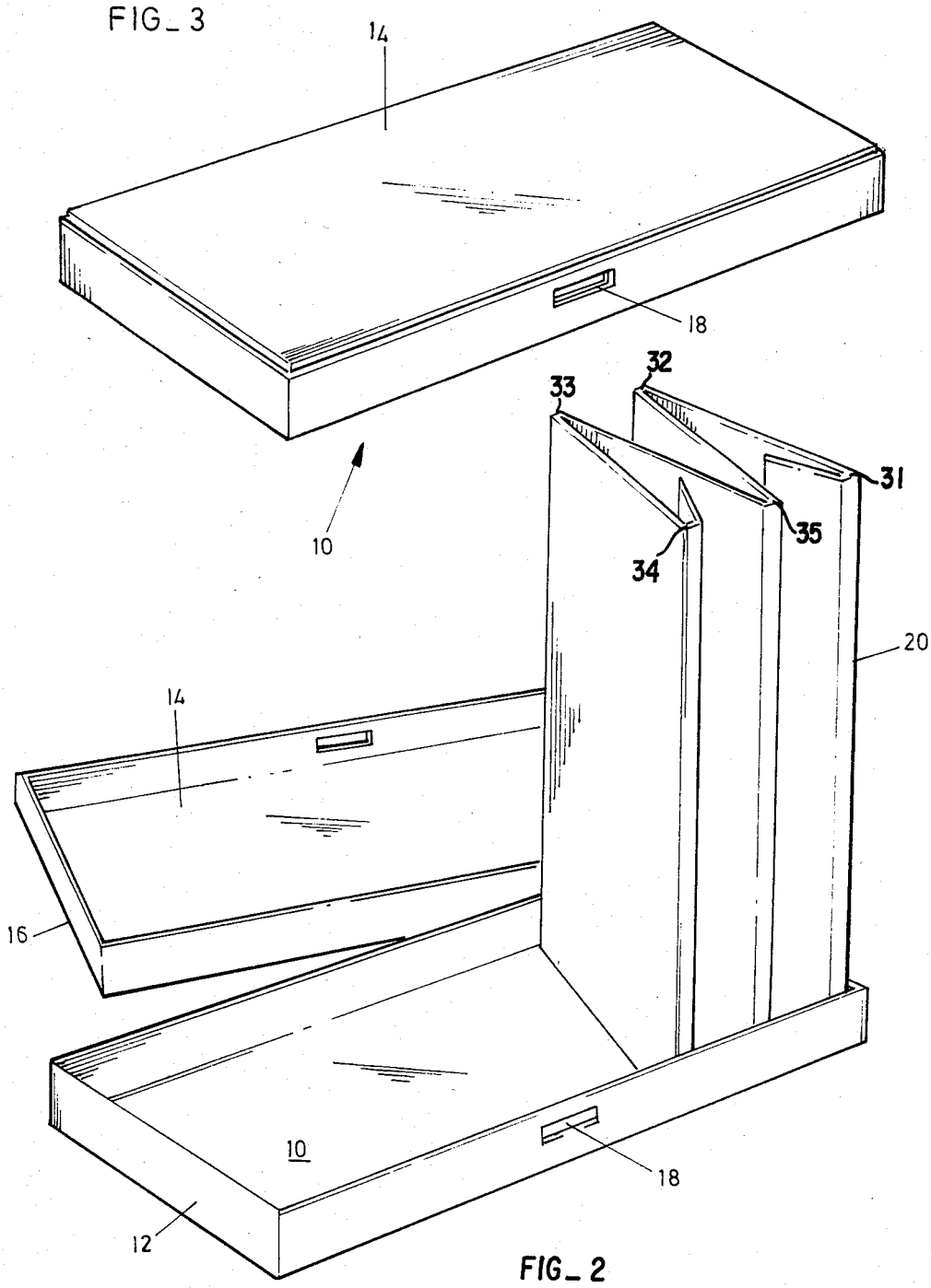
FIG. 2 is an isometric view of the table partially dissembled.
FIG. 3 is an isometric view of the table when completed, folded and packed for cartage.

Referring to the drawings, the table consists of five parts all formed of corrugated cardboard sheeting. The first part is a base 10 having surrounding upstanding edges 12. The second part is a lid 14 which has upstanding edges 16 arranged so that when the lid 14 is placed together with the base 10 a closed box is formed (see FIG. 3). A slot 18 is formed in the upstanding edges 12 and 16 to form a carrying aperture for the closed box.

A foldable planar member 20, which forms the third part, fits into the closed box when folded and when unfolded (FIG. 1) fits with its opposite extreme surface regions against the upstanding edges 12 and 16 to support the lid 14 relative to the base 10. FIG. 3 shows planar member 20 with four transverse fold lines 31–34 which form four corners which correspond to the respective four corners of the lid and base when member 20 is unfolded and assembled as shown in FIG. 1. A transverse fifth fold line 35 allows the member 20 to fold along a line intermediate between fold lines 32 and 33. Two foldable rectangular open box structures 22 and 24, the fourth and fifth parts, fit inside the member 20 and lock into their rectangular configuration to urge the extreme regions of the member 20 towards the upstanding edges 12 and 16. One surface of each structure 22 and 24 is secured to the inside surface of the member 20, as illustrated in FIG. 4. When the member 20 is to be folded the structures 22 and 24 are collapsed to fold against the respective inside surfaces of the member 20 to allow the member 20 to fold and fit into the closed box (FIG. 3).

The collapsible table described is transported from site to site in the form of a closed box (FIG. 3) and assembled (FIG. 1) for use. The table is particularly useful for displays and demonstrating goods in shops. The base 10, lid 12 and member 20 can be suitably decorated with suitably coloured decorations, symbols, goods identifying trade marks and the like. Further, the structures 22 and 24, together with the open side of the member 20, form open access shelving to store goods and demonstration aids. As the table is readily collapsible and easily carried, the table can be removed from the shop area after each demonstration or after a short term display of the goods, after folding the table. This has the advantage that the described table is not an obstacle for cleaning machines and the like during cleaning periods which are normally outside shop trading hours.

The two structures 22 and 24 may be replaced by a single box-like structure arranged to fit inside the member 20. The single structure is arranged to fold and fit inside the closed box (FIG. 3) as required.

The table may be provided with a canopy (not shown) which is supported by rods which are releasably securable to the assembled structure (FIG. 1.).

The parts of the table may alternatively be made of plastics material sheeting or other suitably rigid material.

In assembled form, the table can be used as described for display and demonstration of goods. The table can also be used as a temporary support structure for many other purposes, including picnics.

The top 14 may be provided with an upstanding lip (not shown). This prevents articles placed on the top from falling off the sides of the lid surface. This may be particularly useful when demonstrating self-propelled toys, for example. The lip may be in the form of foldable flaps for example, which are fixed to each upstanding surface 16. The lip may be in the form of a hoop which is arranged to fit around the edges of the lid 14 and extends upwards beyond the surface of the lid 14.

I claim:

1. A collapsible table comprising a rectangular base having upstanding edges which meet to form four upstanding corners of the base, a lid having upstanding edges which meet to form four upstanding corners of the lid, the lid being arranged to form a closed box with the base when the lid and base are fitted together and the upstanding edges mate against one another, a foldable planar member arranged to fit when folded into the closed box and when unfolded to fit with opposite extreme surface regions thereof respectively against the upstanding edges and into the four corners of both the base and the lid and to support and hold the lid in a spaced parallel position relative to the base, the foldable planar member having a width corresponding to the height of the table when assembled and a length which is less than the total peripheral dimension of the assembled table, the planar member having five transverse fold lines, four of which correspond to and extend between the respective four corners of the base and lid and the fifth fold line allowing the planar member to fold intermediate its total length to enable the planar member to fit into the closed box, the planar member forming an incomplete surround for the table so that there is open access into the inside of the table, and foldable rectangular open box means having fold lines and which fits into the closed box when folded and the sides of which when unfolded lock into a rectangular form and present a cross support generally parallel to said lid and base and press against respective inside surfaces of the unfolded planar member to urge the respective extreme surface regions of the planar member towards the upstanding surfaces of the base and the lid so as to form and retain the table in its supporting configuration.

2. A collapsible table according to claim 1, in which said foldable rectangular open box means is secured to and against an inside surface of the planar member and which is arranged to fold inside the planar member such that the rectangular open box means and planar member remain secured together when they are folded and placed in the closed box.

3. A collapsible table according to claim 1, in which the foldable rectangular open box means is positioned so as to be open to allow access to the inside thereof from said one side.

4. A collapsible table according to claim 1, in which the parts thereof are formed of cardboard.

5. A collapsible table according to claim 1, in which the parts are formed of plastics material.

6. A collapsible temporary display table comprising a rectangular base having upstanding edges which meet to form four upstanding corners of the base, a lid having upstanding edges which meet to form four upstanding corners of the lid, the lid being arranged to form a closed box with the base when the lid and base are fitted together and the upstanding edges mate against one another, a foldable planar member dimensioned to fit when folded into the closed box and when unfolded to fit with opposite extreme surface regions thereof respectively against the upstanding edges and into the four corners of the base and the lid and to support the lid in parallel spaced position relative to the base, the foldable planar member having a width corresponding to the height of the table when assembled and a length which is less than the total peripheral dimension of the assembled table, the planar member having five transverse fold lines, four of which correspond and extend between the respective four corners of the base and lid and the fifth fold line allowing the planar member to fold intermediate its total length to enable the planar member to fit into the closed box, the planar member forming an incomplete surround for the table so that there is open access into the inside of the table, and two foldable rectangular open box structures each having fold lines and which fit into the closed box when folded and the sides of which when unfolded lock to form two open access boxes inside the table, and having contiguous and planar upper surfaces which form a cross support generally parallel to said lid and base and press against respective inside surfaces of the unfolded planar member to urge the respective extreme surface regions of the planar member towards the upstanding surfaces of the base and the lid so as to form and retain the table in its assembled configuration.

* * * * *